US010519679B1

(12) United States Patent
Bennett

(10) Patent No.: US 10,519,679 B1
(45) Date of Patent: Dec. 31, 2019

(54) PLUNGER ARTIFICIAL WAVE MAKING APPARATUS

(71) Applicant: Walter Judson Bennett, Mechanicsville, VA (US)

(72) Inventor: Walter Judson Bennett, Mechanicsville, VA (US)

( * ) Notice: Subject to any disclaimer, the term of this patent is extended or adjusted under 35 U.S.C. 154(b) by 23 days.

(21) Appl. No.: 16/119,532

(22) Filed: Aug. 31, 2018

(51) Int. Cl.
*E04H 4/00* (2006.01)
*A63B 69/00* (2006.01)

(52) U.S. Cl.
CPC ..... *E04H 4/0006* (2013.01); *A63B 69/0093* (2013.01)

(58) Field of Classification Search
CPC combination set(s) only.
See application file for complete search history.

(56) References Cited

U.S. PATENT DOCUMENTS

| | | | | |
|---|---|---|---|---|
| 375,684 | A | 12/1887 | Russell | |
| 490,484 | A | 1/1893 | MacKaye | |
| 586,983 | A | 7/1897 | Wharton, Jr. | |
| 716,775 | A | 12/1902 | Smith | |
| 2,002,043 | A * | 5/1935 | Price | E04H 4/0006 4/491 |
| 2,019,829 | A | 11/1935 | Price | |
| 2,056,855 | A | 10/1936 | Herz | |
| 2,222,010 | A | 11/1940 | Witte | |
| 2,908,141 | A | 10/1959 | Marsh, Jr. | |
| 3,005,207 | A | 10/1961 | Matrai | |
| 3,191,386 | A | 6/1965 | Wiegel | |
| 3,299,846 | A | 1/1967 | Jarlan | |
| 3,350,724 | A | 11/1967 | Leigh | |
| 3,373,568 | A | 3/1968 | Hornbostel, Jr. | |
| 3,431,879 | A | 3/1969 | Westling | |
| 3,472,032 | A | 10/1969 | Howard | |
| 3,473,334 | A | 10/1969 | Dexter | |
| 3,477,233 | A | 11/1969 | Anderson | |
| 3,487,228 | A | 12/1969 | Kriegel | |
| 3,487,645 | A | 1/1970 | Frankel | |
| 3,557,559 | A | 1/1971 | Barr | |
| 3,789,612 | A | 2/1974 | Richard | |
| 3,817,040 | A | 6/1974 | Stevens | |
| 3,927,330 | A | 12/1975 | Skorupinski | |
| 3,973,405 | A | 8/1976 | Duport | |
| 3,986,471 | A | 10/1976 | Haselton | |
| 4,062,192 | A | 12/1977 | Biewer | |

(Continued)

FOREIGN PATENT DOCUMENTS

| | | | | |
|---|---|---|---|---|
| GB | 375684 A * | 6/1932 | | E04H 4/0006 |
| WO | WO 1991014062 A1 | 9/1991 | | |

(Continued)

*Primary Examiner* — Kyle Armstrong

(57) ABSTRACT

A wave making apparatus for creating a surfing wave in a body of water. The waves are generated using a controlled up and down motion of Fiber Glass, (FRP), or EPS Geo Foam Mechanical Plungers in a way that allows the control and shape and therefore surf characteristics of the wave. The plunger wave making apparatus is assembled side by side in a vertically manner on a 45-degree sloped back wall. Water ballast is added to the front and main compartments of the wave making plungers to optimize power requirements to power the plungers up and down to produce the waves into the body of water.

7 Claims, 6 Drawing Sheets

(56) References Cited

U.S. PATENT DOCUMENTS

| | | | | |
|---|---|---|---|---|
| 4,078,871 | A | 3/1978 | Perkins, Jr. | |
| 4,098,084 | A | 7/1978 | Cockerell | |
| 4,201,496 | A | 5/1980 | Anderson | |
| 4,210,821 | A | 7/1980 | Cockerell | |
| 4,276,664 | A | 7/1981 | Baker | |
| 4,434,375 | A | 2/1984 | Taylor | |
| 4,507,018 | A | 3/1985 | Anderson | |
| 4,539,719 | A | 9/1985 | Schuster | |
| 4,627,240 | A | 12/1986 | Holmes | |
| 4,684,815 | A | 8/1987 | Gargos | |
| 4,686,377 | A | 8/1987 | Gargos | |
| 4,698,969 | A | 10/1987 | Raichlen | |
| 4,705,428 | A | 11/1987 | Anderson | |
| 4,773,221 | A | 9/1988 | Noren | |
| 4,783,860 | A | 11/1988 | Funke | |
| 4,806,048 | A * | 2/1989 | Ito | E04H 4/0006 405/79 |
| 4,810,129 | A | 3/1989 | Guevel | |
| 4,976,570 | A | 12/1990 | Davis | |
| 5,171,101 | A | 12/1992 | Sauerbier | |
| 5,320,449 | A | 6/1994 | Demarteau | |
| 5,342,145 | A | 8/1994 | Cohen | |
| 5,347,145 | A | 9/1994 | Tanaka | |
| 5,564,859 | A | 10/1996 | Lochtefeld | |
| 5,621,925 | A | 4/1997 | Bastenhof | |
| 6,164,870 | A | 12/2000 | Baruh | |
| 6,217,256 | B1 | 4/2001 | Inan | |
| 6,716,107 | B2 | 4/2004 | Lochtefeld | |
| 6,729,799 | B1 * | 5/2004 | Raike | E04H 4/0006 4/491 |
| 9,920,544 | B1 | 3/2018 | Bennett | |
| 2007/0081861 | A1 | 4/2007 | Goble | |
| 2008/0018114 | A1 | 1/2008 | Weldon | |
| 2017/0204627 | A1 | 7/2017 | Trevis | |

FOREIGN PATENT DOCUMENTS

| | | |
|---|---|---|
| WO | WO 2015082871 | 6/2015 |
| WO | WO 2015188219 | 12/2015 |
| WO | WO2015188219 A1 | 12/2015 |

* cited by examiner

PLUNGER ARTIFICIAL WAVE MAKING APPARATUS

FIELD OF THE INVENTION

This invention relates generally to a plunger wave generating apparatus for efficiently producing non-turbulent waves in a body of water. The apparatus is assembled from a plurality of the plungers aligned side by side in a vertically manner to generate waves in a body of water. The wave making apparatus is for use in the field of recreational surfing and generates waves in a body of water either in isolation or with a high repetition rate and which are of a size and repetition rate that are suitable for surfing. The plunger wave making apparatus is assembled from a plurality of the plungers side by side vertically. The plungers are ideally set on the back-wave generator sloping wall at 45-degree angle to generate waves in a body of water. The plunger wave making system produces a swell or wave crests, which then transverses toward the beach area in the body of water.

BACK GROUND OF THE INVENTION

There are many ways to produce waves in a body of water for the purposes of surfing. Some of the current ways to make waves in a body of water are vacuum water drop method, or using compressed air (pneumatic) to push water out of a caisson or wave chamber, or by pulling a plow profile by mechanical means through the water to create a swell, or using a hydraulic ram or pentagraph to push a single module forward and backward to produce a swell.

PRIOR ART

A water drop wave-making apparatus includes a water reservoir apparatus, whereby water is pumped into one or more vertical tanks located at one end of a wave-pool. When full of water, rapid-action valves are opened to evacuate the stored water into the wave-pool by gravity and thus generate a wave. The two principal problems with this method are that the waves are turbulent and also the waves can only be produced at a rate of 30 to 40 per hour depending on the power and capacity of the pumps.

Another example of a surf-pool utilizes a paddle or flap which is hinged at the bottom of the pool and described in U.S. Pat. No. 4,062,192, Frank N. Biewer and U.S. Pat. No. 4,976,570, Walter R. Davis and Todd H. Nahrup. Actuators are arranged to move the paddle to and from in order to generate waves. Due to the smaller volume of water displaced by the paddle, the waves produced by this method are smaller than those produced by a piston. Therefore, do not produce good waves for surfing.

Another example of a type of wave-making apparatus is typified by U.S. Pat. No. 6,716,107, Lochtefeld and U.S. Pat. No. 5,564,859, Lochtefeld and U.S. Pat. No. 5,171,101. A wide, thin jet of pumped water is directed horizontally against a fixed, curved profile in order to simulate a breaking wave. Though popular, a problem is that these do not behave like ocean waves and are regarded by surfers as an entirely different sport.

Another type of apparatus and method for generating waves in a body of water is revealed in US Publication 4976570, Walter R. Davis, and Todd H. Nahraup. A moveable wave-generating member is cyclically reciprocated in the body or water to make waves. A disadvantage of this device is that a chamber and a baffle positioned adjacent the wave generating member dissipates energy from the return stroke. As the dissipated energy can do no useful work, the apparatus is inefficient for producing surfing waves.

Another conventional wave generator is the surf wave generator or Water Cannons or Set Wave System. See. Richard Carnahan. U.S. Pat. No. 5,833,393 A and Garrett Johnson, US20090038067. The Set Wave System wave generator uses compressed air to release water from caissons to form a wave. The surf wave generator uses rows of caissons positioned along a side of the pool. More specifically, the caissons of the surf wave generator are generally positioned vertically along a back side of the pool.

Another conventional wave generator is a plow that is pulled through the water by mechanical means and produces a simulated wave. The plow can be designed in different shapes, such as a conventional snow plow shape or a delta wing shape or tear drop shape. These plows can be pulled by a motor and cable system or they can be affixed to a tracking system driven by a motor or linear motor drive system. See. Odriozola Sagastume, US20100017951 A1.

Another conventional wave generator is the hydrofoil system. A plurality of hydrofoils are placed or connected as arms to a track system that moves the hydrofoil through the water to produce surfable waves. One or more foils, each foil arranged vertically along at least a major part of a the side wall and adapted for movement in a direction along a length of the side wall, each foil having a curvilinear cross-sectional geometry that defines a leading surface that is adapted to generate a wave in the water from the movement, and a trailing surface configured for flow recovery to avoid separation of the flow of water in the wave and mitigate drag from the foil from the movement; and a moving mechanism connected between the side wall and the one or more foils for moving the one or more foils in the direction along the length of the side wall to generate a surface gravity wave by each of the one or more foils. See. Kelly Slater US20100124459 A1.

Another conventional wave generator is the mechanical piston flume wave generator design. A wave generating module for a wave-making apparatus comprising a flume which is flooded water through an open end, a back wall which blocks the flume, and a barrier constrained to move along the flume intermediate the back wall and the open end, characterized by a reciprocating means arranged to displace the barrier towards the back wall to generate a wave toward the back wall that is reflected from the back wall to assist subsequent displacement of the barrier away from the back wall in generating a wave through the open end. See. John Baxendale. WO2015082871 A1.

Another single module piston wave generator that moves back and forth is Patent WO2017077156A3, CA3003642A1, Sagastume Jose Manuel Odriozola, A piston is understood to be a panel which repeatedly moves backwards and forwards within a mass of water, which is repeatedly tilted backwards and forwards within a mass of water, or which presents a combination of both movements (translation and tilting) with respect to a mass of water, in order to move water horizontally.

In an attempt to generate surfable waves using the piston technique, wave generator systems have been developed based on a series of pistons that are aligned or placed in a row, and operate in a sequence to obtain a wave that breaks gradually and with an optional barrel, the wave suitable for surfing. Examples of such systems can be found in U.S. Pat. No. 6,920,651, Michael Kevin Roberts U.S. Pat. No. 4,062,192, Biewer and U.S. Pat. No. 4,783,860, Edgar R. Funke, Michael Miles, Larry Corish.

The last type of wave making apparatus are of the plunger type, as in the current invention. In U.S. Pat. No. 9,920,544 B1, Walter Bennett John Bushey and Matthew Gunn, is a plunger wave maker that is made out of steel panels with foam structure padding on the front and bottoms of the plungers. Unlike in the current invention where EPS Geo foam is used on the inside of the plungers, with a fiber glass (FRP) outer skin shell. This patent also teaches away from the current invention, because it teaches to use a hydraulic actuator connected to a belcrank and drive link mechanism to push down and pull up the plungers. This invention does mention ballast in the patent, however does not teach where the ballast is located, the type of ballast (water, cement, sand, lead) or how the water ballast enters the plungers. The current invention uses water ballast and the water ballast enters the ballast compartment through round holes in the sides of the front and main plunger compartments. This invention teaches that the inner part of the plungers are hollow. In the current invention, the inner part of the plunger is filled with EPS Geo Foam with a fiber glass compartment located underneath the foam to hold the water ballast.

In US Patent, 20170204627A1, and WO2015188219A1, Aaron James Trevis, the invention provides wave generating apparatus for generating at least one wave in a surface of a body of water, comprising at least one wave generating object, means for causing the wave generating object to oscillate vertically relative to the surface, with the wave generating object in contact with the body of water for at least some of the time, wherein the at least one wave generating object has at least one wave generating surface and wherein where there is a single wave generating object, the wave extends away from the wave generating object and wherein where there are multiple wave generating objects, the wave generating objects and wave generating surfaces are configured such that substantially all of any waves generated extend away from the wave generating objects. In another broad form the invention provides a method of generating at least one wave in a surface of a body of water, comprising providing at least one wave generating object, causing the wave generating object to oscillate vertically relative to the surface, with the wave generating object in contact with the body of water for at least some of the time, wherein the at least one wave generating object has at least one wave generating surface and wherein where there is a single wave generating object, the wave extends away from the wave generating object and wherein where there are multiple wave generating objects, the wave generating objects and wave generating surfaces are configured such that substantially all of any waves generated extend away from the wave generating objects. In a preferred form a wave generating surface includes a surface angled to the direction of oscillation. Oscillation may be along a linear path or may be by rotation about an axis. Oscillation along other path shapes is within the scope of the invention. A wave generating object may be configured so that its oscillation causes waves to extend in substantially all directions. A wave generating object may be configured so that its oscillation causes waves to extend in one or more directions. The wave generating surface may be a revolution of part of a straight line, a portion of a circle, ellipse, or parabola shaped plunger.

The wave generating apparatus wherein the at least one wave generating surface is caused to oscillate: whilst remaining substantially in the water; partially out of the water, or totally out of the water.

The wave generating apparatus wherein the drive mechanism drives the at least one wave generating object toward the water or further into the water, with buoyancy causing movement in the opposite direction.

This patent teaches away from the current invention, as this patent also does not use Fiber Glass, (FRP) or Geo Foam to make their plungers. This patent teaches of using inflatable plungers. This patent also does not discuss using water ballast to balance the static forces and dynamic forces and limiting the load on the hydraulic power system or balancing the static forces of gravity and buoyancy by using water ballast. This invention also does not have the same design and shape as in the current invention. Their plungers are circle, ellipse, or parabola. This invention also does not use wide flanged beams for guides nor wheel assemblies to allow the plungers to go up and down to produce a wave in the body of water. This patent also places their plungers in a circle circumference. Where in the current invention the wave making plungers are aligned in a linear lined fashion side by side.

In U.S. Pat. No. 3,477,233, Anderson, dated Nov. 11, 1969, disclosed a wave making machine which consists of a buoyant plunger which is moored to float adjacent a back board. The floating plunger is held in an upright position by means of submerged counter weights. An oscillating drive mechanism consisting of a weight displacement mechanism is mounted on the plunger. A back board is supported by piling driven into the bed of the body of water.

In U.S. Pat. No. 4,201,496, Anderson, dated May 6, 1982 there is disclosed a wave making machine which consists of a buoyant plunger which is held in an upright position by an outrigger float. A back board is fixed to the plunger member a substantial distance rearwardly thereof.

In U.S. Pat. No. 4,507,018, Anderson, now discovered that a substantially uni-direction of wave propagation can be obtained by employing a plunger in which the back face is substantially planer and vertically oriented and the front face includes a portion which is upwardly and forwardly inclined and by providing a mechanism which ensures that the plunger reciprocates substantially vertically. The improvement wherein said plunger has a wedge shaped upper portion and a thin fin which extends downwardly from the wedge shaped portion, said plunger having a front face and a back face which are oppositely disposed, said front face having a first portion which is downwardly and rearwardly inclined and forms the front face of the wedge shaped portion and a second portion which extends parallel to the back face and forms the front face of the fin, said back face being substantially planner and extending normal to the surface of the water said thin fin serving to space the lower edge of the plunger from the lower end of the inclined first portion of the front face whereby upon periodic motion waves are generated at the front face and substantially no waves are generated at the back face of the plunger.

U.S. Pat. No. 490,484 dated Jan. 24, 1893 to Mackave, describes a wave-making device for use in creating a theatrical effect, intended to produce wave effects over the range of gentle waves, or a succession of waves, or a "choppy" or rough and stormy sea. The device utilizes a vibratory or reciprocal arm or pendulum lever pivotably attached at its upper end to a fixed support with a wave-shoving pusher plate or blade at its other end, and a power shaft attached to a flywheel that is motor driven and drives the arm back and forth in a pendulum-like shoving motion in a horizontal plane, slowly or rapidly, as desired.

Wharton Jr. U.S. Pat. No. 586,983, patented Jul. 27, 1897, also utilizes a reciprocating feathering blade or blades also adapted to move in a horizontal plane along the bottom of the water body and operated by a flywheel.

As swimming pools came into vogue and grew in size, it became apparent that wave-making devices intended for theatrical purposes could be modified to create wave action in a swimming pool. However, devices provided with laterally-reciprocating blades and levers moving about in the body of water were a hazard to swimmers, and another way of achieving the wave action had to be developed.

British Pat. No. 375,684 patented Jun. 30, 1932 shifted the wave-making movement to a vertical plane, and applied air pressure to move the body of water back and forth. Water from the pool was drawn up into a vertical chamber by suction, after which the suction was broken, and air was admitted to the chamber, so that the body of water thus elevated was allowed to fall freely back into the pool. This system avoided all of the mechanical contrivances previously used, but, water being heavy, in order to draw the water up to a sufficient height to create a wave large vacuum pumps were required, which consumed considerable amounts of power.

Another way of achieving wave action in swimming pools utilized reciprocating displacers operating at slightly different speeds, so that there was a cyclic variation of relative stroke position, with regular repetition of the full cycle of variations at intervals determined by the number of strokes constituting the cycle. The displacers were commonly reciprocated approximately in harmonic motion by operating each displacer through a connecting rod driven from a crank. With two displacers driven at slightly different speeds, one crank is continually gaining on the other, and the respective cranks pass through the whole range scale of phase differences during a complete cycle of wave variations. At one time the two cranks will be in phase, at another time 90° apart, and at another time 180° apart. When the cranks are in phase, the highest waves are produced. When the cranks are not in phase, diagonal waves are produced. When the cranks are about 90° apart small rather choppy waves are produced. When the displacer cranks are about 180° apart, one displacer makes downward or forward strokes concurrently with upward or return strokes of the other displacer.

This however leads to considerable short circuiting of water between the two displacers, and this problem was tackled by Price, U.S. Pat. No. 2,002,043, patented May 21, 1935. Price operated a plurality of displacers at all times in phase, so that the short circuit pumping is eliminated. The variation in wave formation is produced by varying the length of the stroke or vibration of one displacer relatively to the others. The displacer was a piston moving up and down in a vertical shaft or chamber, utilizing a walking beam-type of leverage to achieve reciprocation of the piston. The lower face of the piston was in direct contact with the water, and the water was drawn in and pushed out from the chamber in accordance with the vertical position of the piston within the chamber.

In U.S. Pat. No. 2,019,829 patented Nov. 5, 1935, Price indicated that the problem with the utilization of displacers is the large size required, each displacer being ordinarily about 20 feet long or more, and usually constructed of wood. Accordingly, Price sought to reduce the size and simplify the construction of the displacer, but essentially the same wave making principle is employed in this modified device as well.

Herz U.S. Pat. No. 2,056,855 patented Oct. 6, 1936, returned to the suction principle first utilized in British Pat. No. 375,684. However, Herz not only exhausted air from the compartment to raise the level of the water above the normal quiescent level of the pool but also forcibly lowered the water to below the level of the pool by application of pressure. Thus, the water is alternately drawn from the pool and then discharged therefrom under pressure, which amplified the wave-making action of the pulse of water moved up and down in the chamber. While this modification improved the wave-making capability of the system, it also considerably increased the power requirement, and made it even more costly to operate.

Witte et al U.S. Pat. No. 2,222,010, patented Nov. 19, 1940, created waves in the water body by moving a tank-size plunger up and down in the water. Witte et al were primarily interested in theatrical effects, since of course this movement would have been dangerous to swimmers. The tank was reciprocated by a piston, using compressed air.

Matrai U.S. Pat. No. 3,005,207 patented Oct. 24, 1961 utilizes a flip-flop pivotable shover blade sheltering the blade or paddle in a special wave-making housing. An oscillatory motion about the pivot point is imparted to the paddle by a drive shaft moving the paddle back and forth in a full 180° of travel or oscillation, flip-flopping first to one side and then to the other side of the pivot mounting.

Schuster and Boes, Belgian Pat. No. 716,775 granted on Aug. 30, 1968 and issued on Dec. 2, 1968, modified the Herz approach of U.S. Pat. No. 2,056,855 by eliminating the suction part of the cycle, and simply applying air pressure to force the body of water down in a chamber, utilizing compressed air which is applied directly to the water surface. Preferably, the air is alternately led successively upon two adjacent parts of the surface of the pool water, thereby communicating a wave movement to the water in such a way that the maximum height of the waves is located in the middle of the pool. An uneven number of water chambers is provided along one side of the pool, with adjacent chambers alternately being placed in contact with the source of compressed air. If the widths of the chambers is made a multiple of the wavelength of the waves, with a phase displacement of 180° in the apparatus, a body of waves is produced with maximum height in the middle of the pool, unlike the mechanical apparatus previously described, where the phase displacement is relatively small in the middle and strong at the borders of the body of water.

Dexter U.S. Pat. No. 3,473,334, patented Oct. 21, 1969, sought to provide waves of the spilling breaker-type, suitable for surfing. A pump takes water from the pool and discharges it into the wave-producing device, raising the water level in the wave-producing device above the normal water level of the pool. Then a gate in the bottom of the device is opened, and as the water within is lowered, a controlled quantity is forcibly expelled into the pool at a distance below the surface. Substantially all of this expelled portion is deflected upwardly, to create a translatory surface wave upon the body of water, producing waves by utilizing the potential energy of the hydraulic head of the raised portion of water, and a properly proportioned directional control. The pumping rate into the wave-making device is related to the rate of water released to the pool.

Anderson U.S. Pat. No. 3,477,233, patented Nov. 11, 1969, provides a device for making waves on the free surface of a body of water utilizing a buoyant member which is at least partially submerged in the water, and yet floats thereon. Driving means is applied to the buoyant member because of periodic motion thereof relative to the surface of the liquid, such that the amplitude of the motion relative to the surface is unaffected by the level of the surface. The relative motion causes substantial variations in the liquid displacement of the buoyant member.

Barr U.S. Pat. No. 3,557,559 patented Jan. 26, 1971 also is concerned with creating surfing waves. A breaker is formed when the base border of a wave travelling through a body of water impinges a relatively sharply inclining body or floor on the body of water, with the result that the motion of the wave base relative to the wave crest is retarded, due to viscosity, and the crest of the wave advances relative to the base until the latter is no longer capable of vertically supporting the crest, at which point the water in the crest spills over the wave front, and the wave is said to "break".

Barr seeks to duplicate the natural surfing "breaker" wave by confining the water in a trough, and then utilizes a ram-type or pumping pressure discharge-type of pushing device, operating in a horizontal plane, to shove the water down the trough. The drawings show a ram coupled to a power source which thrusts the ram outwardly, causing the surge of water to be forced along the deep channel of the trough, after which the ram is retracted. The principle is thus similar to that of Mackaye and Wharton, with the exception that the water is confined between high walls.

Schuster and Boes, U.S. Pat. No. 3,629,877, patented Dec. 28, 1971, provides a device in which the swimming pool has a width equal to at least one wavelength of the waves in the water, and a standing wave is caused to move along the length of the pool by applying force alternately on first and second adjacent parts of water surface across the width of the pool, with a wave generator in the form of a buoyant plunger mounted for vertical reciprocation within a chamber having an opening facing the pool. Through a cyclic control system, the plunger is driven in phase with the forces of gravity and buoyancy acting thereon, starting from a rest position through strokes of increasing amplitude until a desired steady state is attained, to sequentially produce waves of the desired energy.

In one form of wave generator, the reciprocating enclosure has an open bottom with air purge valves on its upper face connected to a prime mover for raising the enclosure. Upon lowering the enclosure, the purge valves open, allowing air to escape, while the open lower end of the tank enters the water for filling to a predetermined level. Then, when the tank is pulled up with the purge valve closed, a volume of water within the tank is upwardly displaced, and released when the hydrostatic equilibrium between the contained water and the outer water is upset, as when the open lower end of the tank breaks the surface of the water.

All of these devices have in common relatively high costs of operation and maintenance. When the water is moved by application of mechanical means such as a reciprocal paddle, blade or piston, there is considerable wear and tear on the mechanical parts, due to the weight of the water, and the impact of the mechanical parts on the water when they change direction. If air pressure or compressed air is used as the motive force, a considerable pressure has to be built up before the water can be made to move at a rate sufficient to create a wave, and this requires considerable energy, applied through compressors, which are quite expensive to operate, and which also may require cooling devices because of the heat released in the compression of the air.

In U.S. Pat. No. 4,276,664, Baker, an apparatus for making waves in bodies of water used for swimming, comprising, in combination:

(1) a housing;

(2) a plurality of hollow pistons in the housing mounted for reciprocation in alternating power and suction strokes and arranged in balanced groups in which the movement of each piston engaged in a power stroke is opposed to the movement of an adjacent piston engaged in a suction stroke;

(3) each piston having an open bottom for reception of water into the lower portion of the hollow piston from the body of water and a closed top confining a gas cushion there within between the top and any water within the lower portion of the piston, the gas cushion being under a first pressure during a power stroke of the piston, and under a second lower pressure during a suction stroke of the piston;

(4) pressurized gas supplying means for communication with and periodic replenishment of the gas within the gas cushion of the piston to maintain the gas cushion at a selected volume or pressure;

(5) a plurality of separate passages and ports in the housing admitting water into the housing from the body of water, the passages and ports being isolated from each other within the housing, with each separate passage being in fluid flow connection at one end with its own port and at the other end with the interior of one hollow piston;

whereby on the suction stroke each piston draws water into its interior via its passage and port from the body of water, and on the power stroke each piston pushes water from its interior via its passage and port back into the body of water, the resulting alternating pulses of water flow generating waves in the body of water beyond the housing moving in an outward direction from the housing, and the gas cushion in each piston acting as a shock absorber reducing mechanical wear on the piston in reciprocating movement thereof.

In U.S. Pat. No. 3,789,612, Richard, 02/1974, A method of generating waves in a body of water comprising: supporting a rigid body in the water for vertical oscillation of the body relative to the surface of the body of water in response to an imbalance of the forces of buoyancy and gravity acting on the body; and applying an external force during one, at least, of the directions of oscillation of the body, in phase with the greatest one of the forces of buoyancy and gravity then acting on the body.

In U.S. Pat. No. 3,350,724, Walter Leigh, 11/1967, Apparatus for generating waves in a body of water, comprising: a pair of spaced, normally upright walls to be placed in said body of water, said walls being vertically dimished to protect a distance above the water surface, a wave-generating unit including wave-generating means between said walls adjacent one end thereof for generating in said water a wave motion which travels outwardly from said generating means between said walls, whereby said walls confine said wave motion in the lengthwise direction of the waves thereof, and said walls being flat and diverging at a constant angle in the direction of travel of said wave motion.

In summary of the above cited prior art. These patents teach away from the current invention, as these patents do not use Fiber Glass, (FRP) or EPS Geo Foam to make their plungers or pistons. Specifically using EPS Geo Foam on the inside of the plungers with a Fiberglass outer skin. These patents also do not discuss using water ballast to balance the static forces and dynamic forces and limiting the load on the power system. These patents do not teach of using round holes to fill the water ballast compartments of the plungers. These patents also do not have the same design and shape as in the current invention. These patents also do not use wide flanged beams for guides nor wheel assemblies to allow the plungers to go up and down to produce a wave in the body of water. The Patents also do not teach of placing their plungers or pistons on a 45-degree sloped back wall. In the patents discuss 90 degree straight up and down placement of their plungers.

SUMMARY OF THE INVENTION

A wave generating apparatus comprising of a plunger wave generator. The wave making apparatus comprising a plurality of the wave-making plungers arranged side by side vertically to produce a wave into a body of water. The advantages of the current invention over other inventions:

Other plunger wave generators are made out of steel or stainless steel. There are many disadvantages with using steel to construct the wave making plungers. Steel in todays economy has become extremely expensive and especially with tariffs from importing steel from foreign countries, such as China. Steel also is hard to fabricate when using large steel sheets, as it requires large CNC cutting machines to cut out the steel panels to make the plunger sides. Steel is extremely heavy and requires large cranes on site to assembly the plungers or is very expensive to make them at the fabrication shop and ship them to the site. Steel plungers also require zinc coating dipping to prevent rust in long exposures in chemical treated water. This can be costly and often does not work long term.

A major improvement in the current invention is to make the wave making plungers out of Fiberglass or Fiberglass Reinforced Plastic (FRP) or (GRP), or EPS Geo Foam Blocks (expanded polystyrene) or a combination of the two materials. Fiberglass, GRP and FRP are the same material and are interchangeable in definition. The cost of the material is very reasonable. The material is light weight and is easy to work with in fabricating and assembly. The cost of Geo Foam or Fiberglass is a less than that of stainless steel. The Fiberglass or Geo Foam Plungers can be easily fabricated at the shop and shipped for a reasonable cost. These plungers can be lifted up by a few people or can be lifted with small machinery to install the wave plungers.

When using just Fiberglass or EPS Geo Foam (expanded polystyrene), wave making plungers can create strong buoyancy forces. These static buoyancy forces on the plungers can put a heavy demand and load requirement on the power system being used to push down and pull up the plungers to produce a wave. Many different kinds of actuators or drive systems can be used. Such as pneumatic, electric, servo linear or Hydraulic actuators to power the wave making plungers up and down to produce the waves into the body of water. These static forces can also put great upward force demands on the guide system or wheel assemblies that are assisting the plungers in moving up and down.

By adding water ballast to the very front compartment of the plungers and in the main plunger body will help offset and balance out these forces to allow more optimal load requirements on the power system and reduce the upward forces on the guide system. The water ballast can self-enter the plunger compartments by placing round diameter holes on the sides of the front plunger compartment and placing round diameter holes on the sides of the main plunger compartment. This allows the plungers to self-fill themselves with ballast water while in the down position at the bottom of the body of water.

Steel plates are strategically placed inside the fiberglass skin or over the geo foam to allow for strong rigid connection points for the wheel assemblies or guide systems and also for the hydraulic actuators to connect to the wave making plungers to pull them up and down. Steel rods connect the top steel plate and the bottom steel plate with the Geo Foam in between the two steel plates.

DETAILED DESCRIPTION OF THE DRAWINGS

Before any aspect of the invention are explained in detail, it should be understood that the invention is not limited to its application in the details of construction and the arrangement of components set forth in the following description or shown in the following drawings. The invention is capable of other aspects and of being practiced or of being carried out in various ways. Also, it should be understood that the phraseology and terminology used herein is for the purpose of description and should and should not be regarded as limited.

Before any aspects of the invention are explained in detail, it is to be understood that the invention is not limited in its application to the details of construction and the arrangement of components set forth in the following description or shown in the following drawings. The invention is capable of other aspects and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and variations thereof are used broadly and encompass both direct and indirect mountings, connections, supports, and couplings. Further, "connected" are not restricted to physical or mechanical connections.

As used herein, the term surfing is defined to include bodysurfing, board surfing, sail boarding, wake boarding and any other recreational activity that requires waves. Thus, the present invention is useful for a variety of surf related activities, and the terms "surf" or "surfer" or "surfing" should be construed as meaning any surf related activity and its participants.

Figure 1:
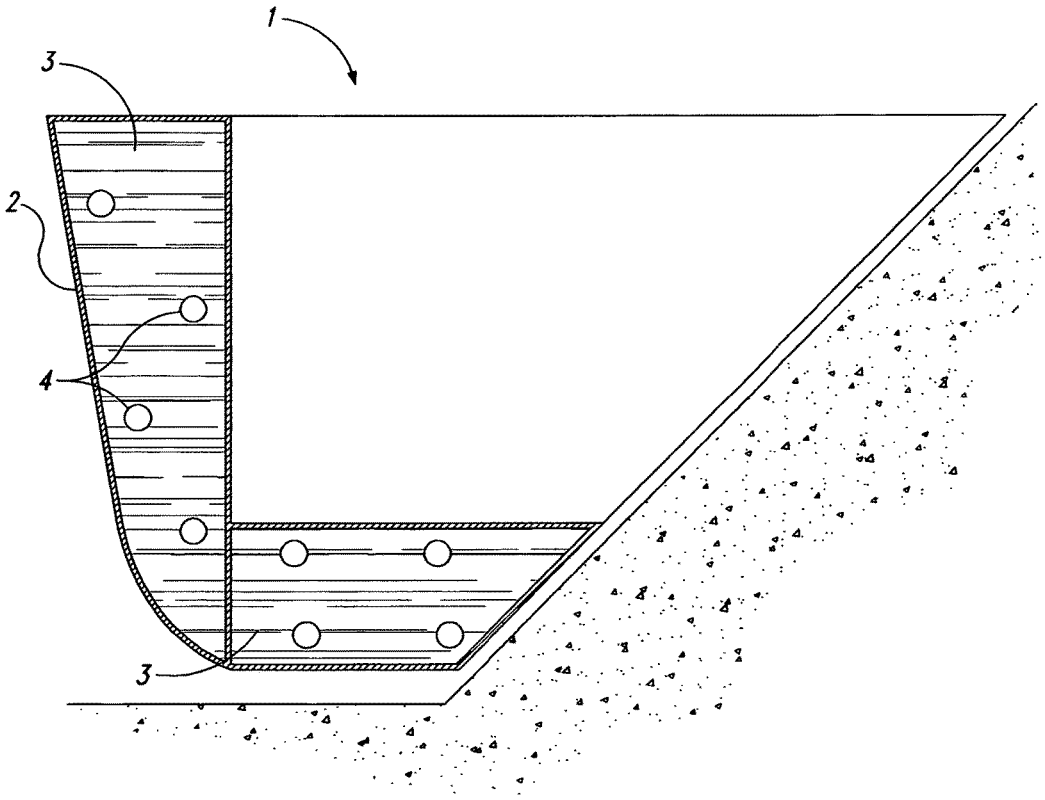
FIG. 1 A side view illustration of one embodiment of the plunger wave generator according to the present invention.

Description of FIG. 1

A wave making plunger 1 illustrated in a side view. The plunger 1, is filled with water ballast 3 in the front compartment 2 of the plunger 1. The plunger also has water ballast 3 in the bottom of the main body of the plunger 1. The water ballast 3 enters the front compartment 2, and the main body of plunger 1, by means of round holes 4 on the sides of both areas. The plunger fills with water ballast 3 when the plunger 1 is in the down position.

Figure 2:
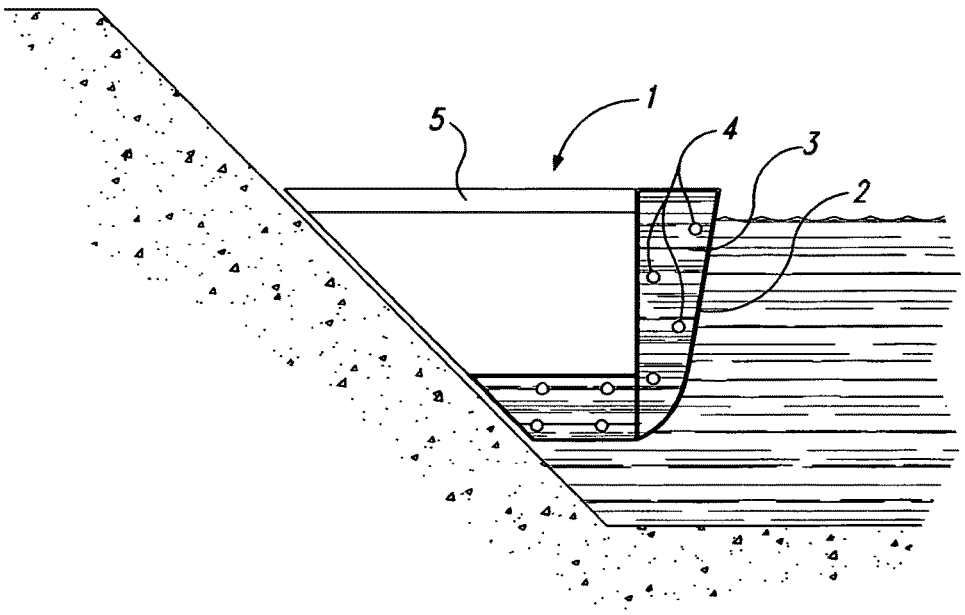
FIG. 2 A side view illustration of the plungers, showing the plunger filling with water ballast through the ballast holes.

Description of FIG. 2

A wave making plunger 1 illustrated in a side view. Water Ballast 3 enters the front plunger compartment 2 and the bottom of the main body of the plunger 1 through water ballast holes 4. The plunger 1 is secured at the top by a steel plate 5.

Figure 3:
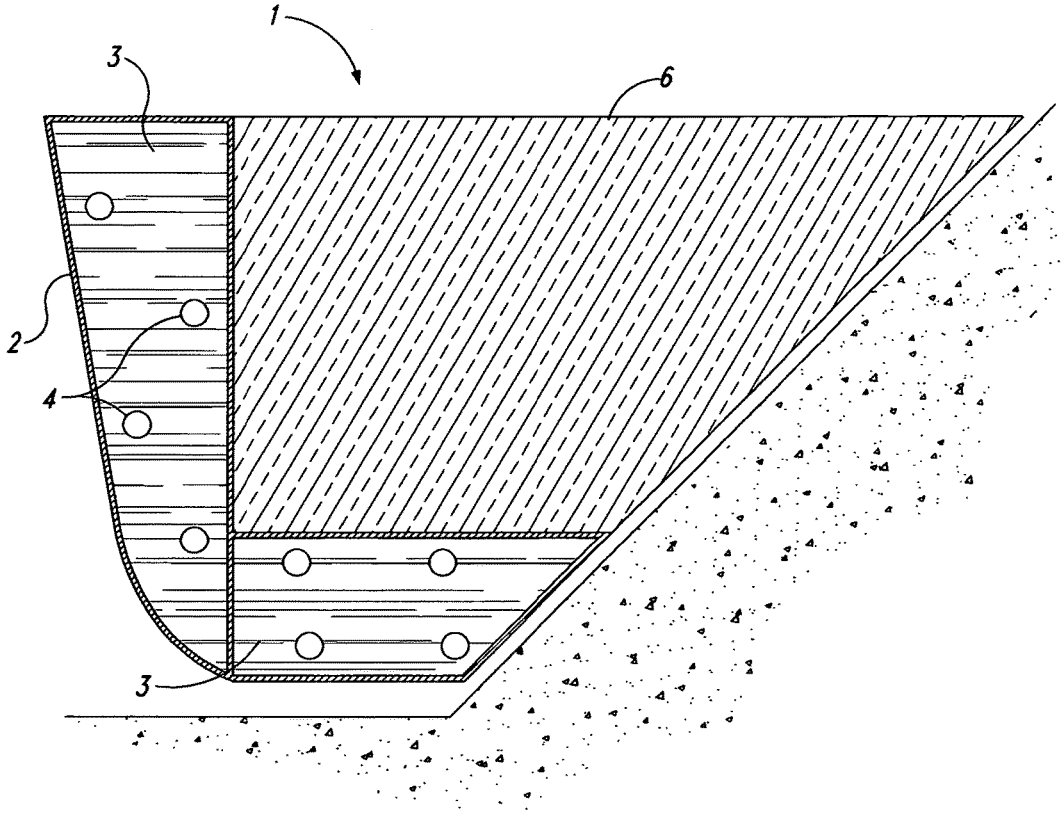
FIG. 3 A side view illustration of the fiber glass plungers.

Description of FIG. 3

A wave making plunger 1, constructed of Fiberglass 6. There is water ballast 3 shown inside the front plunger portion 2 and in the bottom of the main body of the plunger 1. The water ballast 3 enters through ballast holes 4.

Figure 4:
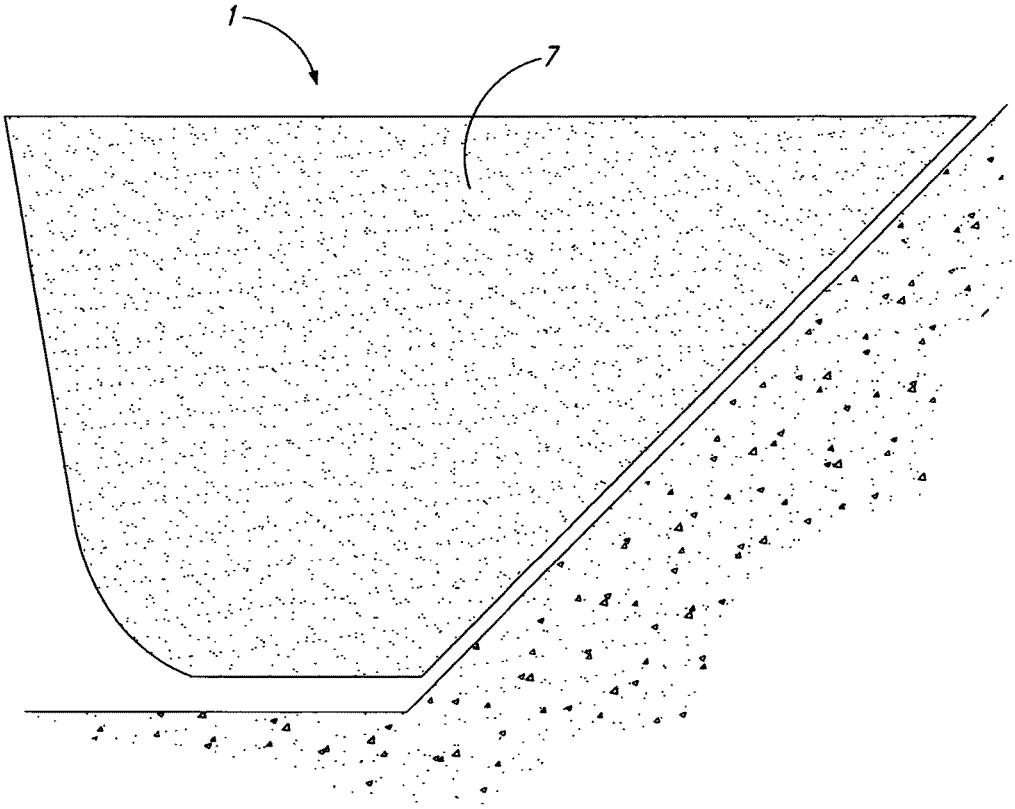
FIG. 4 A side view of illustration geo foam plungers.

Description of FIG. 4

A wave making plunger 1, constructed of Geo Foam, 7.

Figure 5:
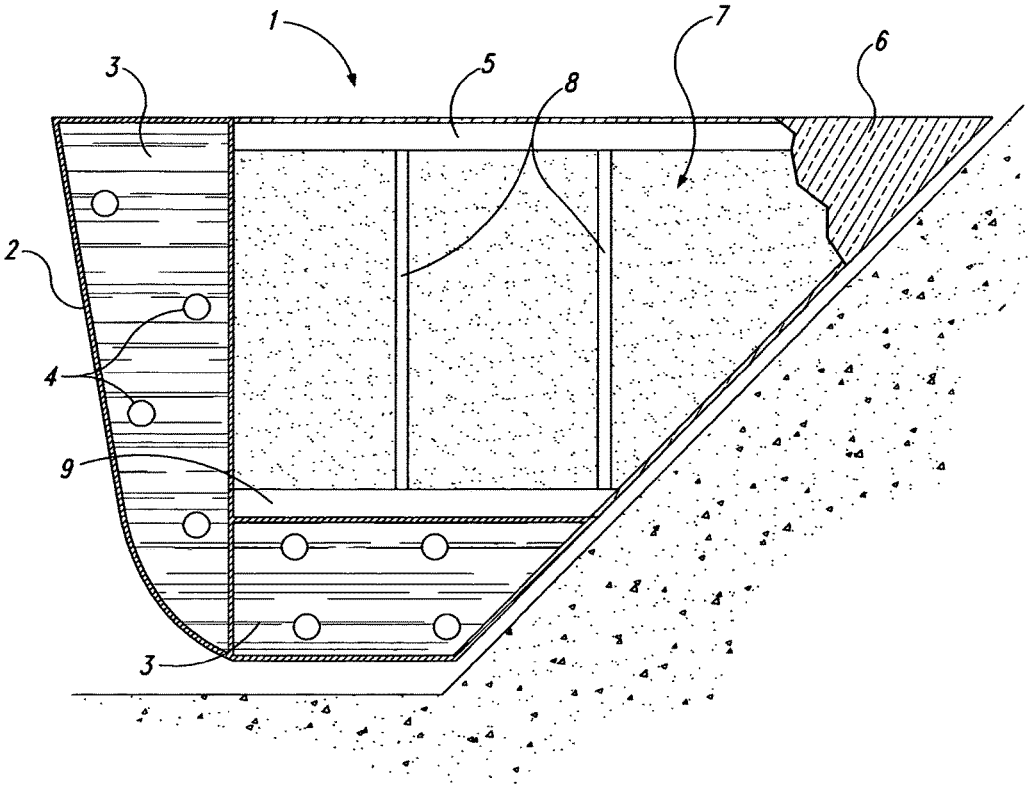
FIG. 5 A side view illustration of the geo foam and fiberglass combination plungers.

Description of FIG. 5

A wave making plunger 1, constructed of Fiberglass, 6 and Geo Foam, 7. The inner portion of the plunger 1, is constructed of Geo Foam 7. The out portion of the plunger 1, is constructed of fiberglass, 6. There is a front fiberglass compartment 2, that holds the front water ballast 3. There is also water ballast 3 in the bottom of the main body of the plunger 1, that holds the water ballast 3. The water ballast 3 in the front compartment 2 and in the bottom of main body of the plunger 1, have holes 4 to allow water ballast 3 to enter the plunger 1. There is a top steel plate 5 and a bottom steel plate 9, connected by two steel rods 8 that hold the geo foam 7 in place inside the plunger 1.

Figure 6:
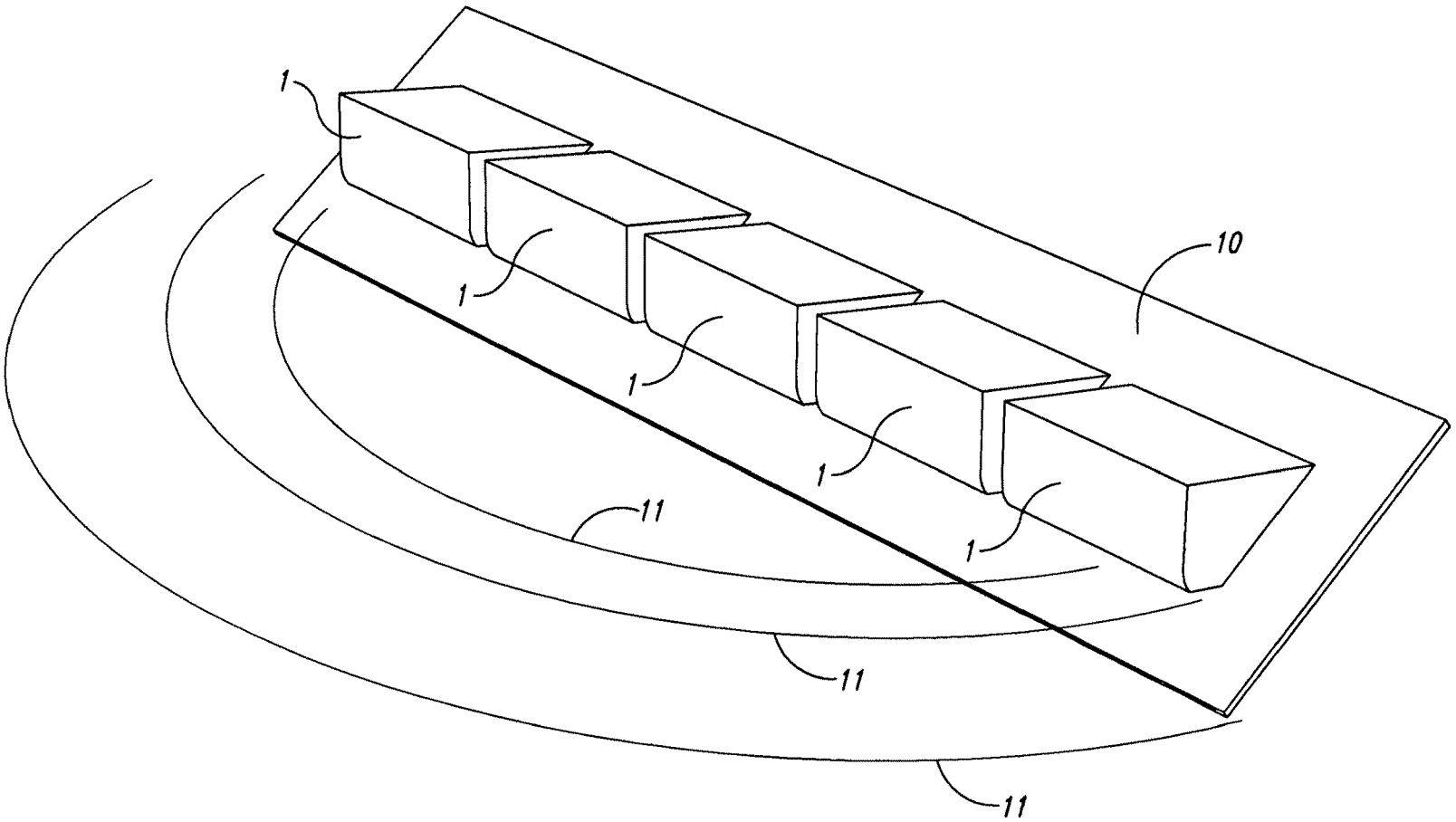
FIG. 6. A top view illustration of a plurality of plungers side by side.

Description of FIG. 6

The illustration shows a plurality of wave making plungers 1, side by side. The plungers 1, are on a 45 degree back sloped wall 10. The wave making plungers 1, produce linear waves 11, into a body of water.

The invention claimed is:

1. A wave making plunger system for generating waves in a body of water comprising:

a plurality of side by side wave generating plungers; wherein each of the plurality of side by side wave generating plungers further comprise:

a main body section, a front ballast compartment, and a lower ballast compartment; wherein the front ballast compartment is attached to the main body section such that the front ballast compartment faces the body of water, and the lower ballast compartment is attached to the main body section at a bottom portion of the main body section;

ballast holes disposed on the sides of the front ballast compartment and the sides of the lower ballast compartment; wherein the ballast holes are open to the environment allowing for ambient water to passively flow in and out of the front ballast compartment and the lower ballast compartment to balance, and reduce, static and dynamic forces; and wherein the wave making plunger system generates linear, non-turbulent waves.

2. The wave generating plunger system as cited in claim 1, further comprising the plurality of side by side wave generating plungers are made out of fiber glass-reinforced plastic.

3. The wave generating plunger system as cited in claim 1, further comprising at least one the plurality of side by side wave generating plungers are made out of expanded polystyrene geo foam.

4. The wave making plunger system as cited in claim 1, further comprising the plurality of side by side wave generating plungers are made out of the combination of fiberglass reinforced plastic and expanded polystyrene geo foam.

5. The wave making plunger system as cited in claim 1, wherein expanded polystyrene geo foam is located inside the main body section of the plurality of side by side wave generating plungers and fiberglass reinforced plastic is fabricated over top of the expanded polystyrene geo foam of the plurality of side by side wave making generating plungers.

6. The wave making plunger system as cited in claim 3, wherein steel plates are placed on the top and bottom of the expanded polystyrene geo foam and, wherein steel rods connect the top steel plate to the bottom steel plate securing the expanded polystyrene geo foam in place.

7. The wave making plunger system as cited in claim 1, wherein the back sloped wall is 45 degrees to the back wall of the plurality side by side wave making plungers.

* * * * *